US010000372B2

(12) United States Patent
Gregory

(10) Patent No.: US 10,000,372 B2
(45) Date of Patent: Jun. 19, 2018

(54) PORTABLE OVERFLOW PREVENTION DISPENSING CONTAINER

(71) Applicant: Michael D Gregory, Moore, OK (US)

(72) Inventor: Michael D Gregory, Moore, OK (US)

( * ) Notice: Subject to any disclaimer, the term of this patent is extended or adjusted under 35 U.S.C. 154(b) by 48 days.

(21) Appl. No.: 15/191,666

(22) Filed: Jun. 24, 2016

(65) Prior Publication Data

US 2017/0369300 A1 Dec. 28, 2017

(51) Int. Cl.

| | |
|---|---|
| ***B67D 7/36*** | (2010.01) |
| ***B67D 7/04*** | (2010.01) |
| ***B65D 25/28*** | (2006.01) |
| ***B65D 25/40*** | (2006.01) |
| ***B65D 41/04*** | (2006.01) |

(52) U.S. Cl.

CPC ..... *B67D 7/362* (2013.01); *B65D 25/2811* (2013.01); *B65D 25/40* (2013.01); *B65D 41/04* (2013.01); *B67D 7/04* (2013.01); *B65D 2205/02* (2013.01)

(58) Field of Classification Search

CPC .... B65D 25/40; B65D 25/2811; B65D 41/04; B65D 7/04; B65D 7/362; B67D 25/40; B67D 25/2811

USPC ..... 141/198

See application file for complete search history.

(56) References Cited

U.S. PATENT DOCUMENTS

| | | | | |
|---|---|---|---|---|
| 4,275,860 A * | 6/1981 | Brabazon | B64F 1/28 | 114/261 |
| 4,640,446 A * | 2/1987 | Walker | B65D 47/061 | 215/398 |
| 2003/0150515 A1* | 8/2003 | Cushing | B65D 25/42 | 141/198 |
| 2007/0215242 A1* | 9/2007 | Bonner | B67D 7/42 | 141/198 |

* cited by examiner

*Primary Examiner* — Timothy L Maust
*Assistant Examiner* — Andrew Schmid
(74) *Attorney, Agent, or Firm* — Kerry D. Green

(57) ABSTRACT

An overflow prevention dispensing container comprising a portable container having at least one handle means, a nozzle, at least one air vent, at least one liquid fill aperture, and fill aperture cover; a dispensing handle having a valve mechanism; and at least one release; an automatic shutoff sensing means for sensing the level of fluid in a receiving tank and stopping the flow of liquid into the receiving tank when it is full, whereby the container is placed in a position to dispense liquid to the receiving tank, the operator activates the dispensing handle allowing liquid to freely flow into the receiving tank until the apparatus senses the level of the liquid in the receiving tank to be desired level at which time the flow will automatically be stopped.

13 Claims, 3 Drawing Sheets

PORTABLE OVERFLOW PREVENTION DISPENSING CONTAINER

CROSS-REFERENCE TO RELATED APPLICATIONS

None.

FIELD OF THE INVENTION

The invention generally relates to refueling a vehicle in a remote location. In particular, the invention relates to a portable overflow prevention dispensing container, wherein the portable overflow prevention dispensing container is used by a person to refuel a vehicle such as an all-terrain vehicle (ATV), a utility terrain vehicle (UTV) or a personal watercraft (PWC) in their normal operating environment such as a forest or on a body of water while preventing overfilling the fuel tanks which causes excess fuel to spill and contaminate the environment.

BACKGROUND

Refueling containers come in a variety of shapes and sizes. Current refueling containers have many typical traits in common such as a container for retaining the fuel, a nozzle, and an integrated handle. Some refueling containers have the ability to control the flow of fuel but require the user to release the control in a timely fashion to prevent overfilling. Additionally, the refueling tank sizes commonly hold 2-5 gallons of fuel. A PWC, ATV, or UTV may hold anywhere from 5 gallons of fuel to 25 gallons with the more common range to be between 7-15 gallons. Currently, there are some no-spill systems that use a button on a small container that allow a user to fill up the small fuel tank on a lawn mower, but this type of system would require multiple fuel containers in a single setting to refuel a PWC, ATV, or UTV just once thereby increasing the possibility of a spill and environmental contamination. Additionally, manipulating a small button on a "no-spill" container of a size sufficient to fill a PWC, ATV, or UTV would be difficult in its current configuration due to the size and weight of the fuel and would likely result in a spill and environmental contamination.

SUMMARY OF THE INVENTION

The present invention overcomes these shortcomings by providing an apparatus that allows a user to control and fill a fuel tank on a vehicle such as a PWC, ATV, or UTV while simultaneously preventing overfilling a fuel tank and contaminating the environment. The apparatus may consist of a container, a nozzle, fuel aperture and an auto-shutoff sensor that allows the user to position the nozzle inside the fuel tank, began filling the fuel tank, and have the apparatus automatically stop the refueling operations before fuel is spilled.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
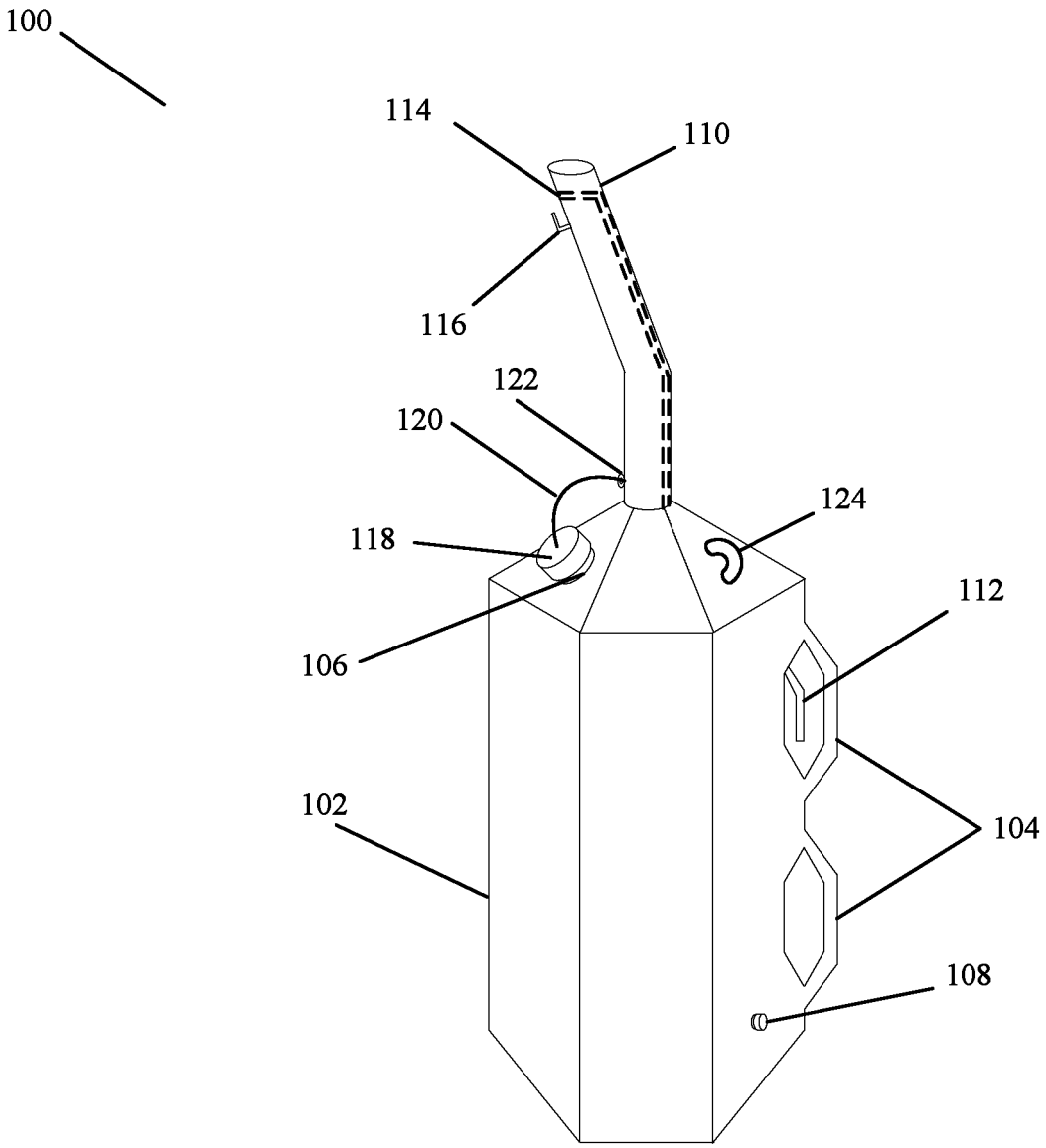
FIG. 1 is a perspective view of one embodiment of the overflow prevention dispensing container.

FIG. 1 is a perspective view of an overflow prevention dispensing container 100. The overflow prevention dispensing container 100 may comprise a portable container 102, integrated handles 104, a fill aperture 106, a nozzle 110, a dispensing handle 112 and an auto-shutoff sensing means 114. The overflow prevention dispensing container 100 allows a user to easily control the container 102 via the integrated handles 104 while fueling a vehicle such as a PWC, ATV, or UTV. The dispensing handle 112 is positioned such that a user may use both hands to control the container 102 while simultaneously dispensing fuel. The portable container 102 is preferably made from plastic materials such as polyethylene but may also be made from materials, including, but not limited to metal. Additionally, a portable container 102 may be shaped in a cylindrical or polygonal form for ease of dispensing fuel into a fuel tank. A handle 104 may be integrated into the portable container 102 for ease of production and ease of use as noted above.

In an embodiment, there are two integrated handles 104 on one side of the portable container 102 and a positioner 116 on the nozzle 110. The positioner 116 may be placed on the rim of the fuel tank to minimize movement relative to the fuel spout it engages while filing, which allows a user to place the nozzle 110 inside the fuel tank in a desired position. The user when pouring fuel into a fuel tank now has a positioner 116 and integrated handles 104 to easily control and dispense fuel while having the sensor 114 in a desired location to sense the fuel level thus preventing the overfilling of the fuel tank.

The portable container 102 receives fuel through the fill aperture 106 wherein a filling cap 118 is removed to allow fuel to be poured inside the portable container 102. The filling cap 118 is connected to a filling cap retainer 120 which is then connected to the portable container 102 at the cap attachment point 122. This feature prevents the filling cap 118 from being dropped but more specifically, it prevents the cap from being lost when refueling a PWC while in the water. The filling cap 118 upon the filling of the portable container 102 is placed back onto the fill aperture 106. The filling cap 118 may be attached to the fill aperture 106 including but not limited to using threads or other securing means adapted to prevent fuel leakage know to one skilled in the art.

Attached to the portable container 102 is a nozzle 110 that allows the fuel to flow from the portable container 102 through the nozzle 110 into a fuel tank. The flow of the fuel from the portable container 102 through the nozzle 110 is controlled by a dispensing handle 112 that allows more fuel to flow as more pressure is applied to the dispensing handle 112 until the maximum flow is achieved. The dispensing handle 112 may be selected from a lever, a switch, or a button to control the flow of fuel from the portable container 102 into the fuel tank. Also inside the nozzle 110 is an auto-shutoff sensor 114 that detects the fuel level and once the fuel has reached a desired level, the sensor sends a signal to the dispensing handle 112 that disengages the handle 112 and prevents any further flow of fuel into the fuel tank. The automatic shutoff sensor may be activated by a number of means selected from an air pressure, ultrasonic, infrared, laser, and radar sensor.

In a preferred embodiment the overflow prevention dispensing container 100 uses the Venturi effect to autosense when the fuel tank is full and prevent further fuel flow into the fuel tank. The auto-shutoff sensor 114 uses the Venturi effect such that as the pressure is changed, the pressure differential will be sensed by the auto-shutoff sensor 114 which is a Venturi tube that is connected to a diaphragm in the valve mechanism 202 internally to the portable container 102 that once it has sensed there is fuel in the auto-shutoff sensor 114, the diaphragm then disengages the valve mechanism 202 which disconnects the dispensing handle 112 thus preventing any more fuel from flowing. The use of the Venturi effect to automatically stop the flow of a fluid is well known to one skilled in the art such as the teachings of U.S. Pat. No. 4,709,735A incorporated herein by reference.

Also contained on the body of the portable container 102 is a attachment point 124 that allows either a retention strap or a grounding strap to be attached between the portable container 102 and a vehicle. In the specific case of a PWC, if the portable container was to slip out of the hands of the user while the PWC was being refueled in the water, this attachment point 124 with a retention strap would prevent the portable container 102 from being lost. Additionally, a grounding strap would reduce the possibility of igniting the fuel.

Additionally, there is an air vent 108 that is attached to the portable container 102 that allows air to enter into the portable container 102 once the container is in the upside-down position. The air vent 108 allows the fuel to flow freely into the fuel tank eliminating the potential for fuel burping and causing premature shutoff thus increasing the potential of spilling fuel. The air vent is preferably comprised of a check valve-type mechanism that allows only one-way flow into the tank through the valve. Moreover, the air vent 108 facilitates in the quick transfer of fuel from the portable container 102 to the fuel tank.

Figure 2:
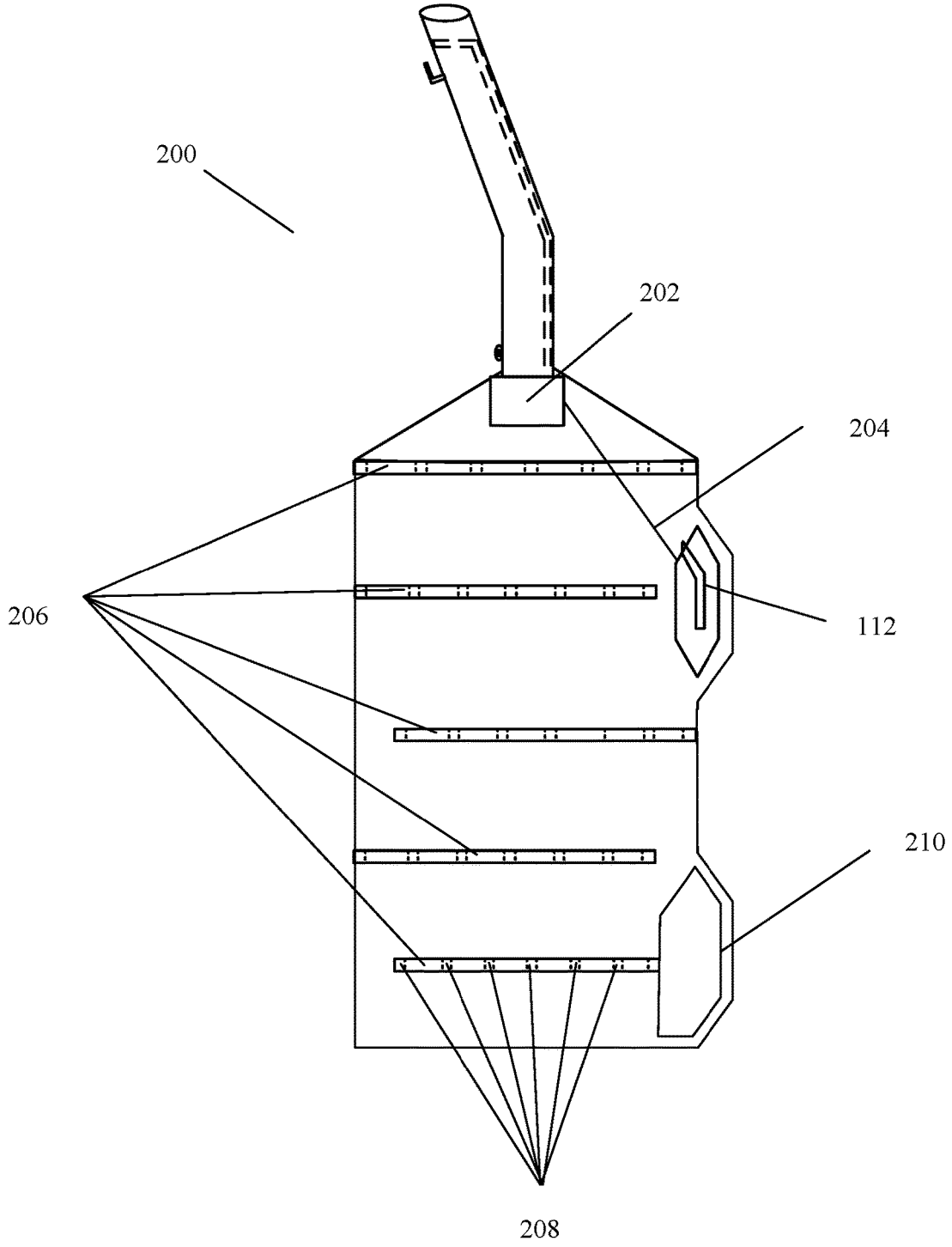
FIG. 2 is an internal view of overflow prevention dispensing container.

FIG. 2 is an internal view of the overflow prevention dispensing container 200. The portable container 102 internally may comprise of a valve mechanism 202, a mechanical linkage 204, baffles 206, and baffle openings 208. The valve mechanism 202 controls the fuel flow from the portable container 102 to the fuel tank and provides the automatic shutoff when a particular level of fuel with inside the fuel tank is reached. After the portable container 102 is positioned, the dispensing handle 112 is depressed such that the mechanical linkage 204 opens the valve mechanism 202 to allow fuel to flow out of the container 102 through the nozzle 110 into the fuel tank. The valve mechanism 202 uses a Venturi to control the fuel flow and detect the level of fuel in the fuel tank. The Venturi creates a low-pressure area that then starts sucking air in through the auto shutoff sensor 114 and as long as this air flow continues through the auto shutoff sensor 114 fuel will continue to flow. At such time when the level of fuel rises within the tank such that is covers the auto shutoff sensor 114, fuel will then be drawn into the valve mechanism 202 that will then activate a diaphragm that will then release the valve thus preventing future flow of fuel.

Additionally, the portable container 102 may contain baffles 206 internally. The baffles 206 are to enable the user to easily control the portable container 102 when filling a fuel tank by preventing sloshing of the fuel when the portable container 102 is positioned to fill the fuel tank. Within the baffles 206 are baffle opening 208 that allows fuel within those sections to freely flow down toward the nozzle 110 when in a filling position thus preventing fuel from becoming trapped inside the container.

As discussed earlier in FIG. 1, there are integrated handles 104 in the preferred embodiment. In the embodiment in FIG. 2, a different style of integrated handle 210 is shown which provides more vertical control as the portable container 102 is moved into a filling position and as that filling position becomes more vertical, the user retains more control using this integrated handle 210.

Figure 3:
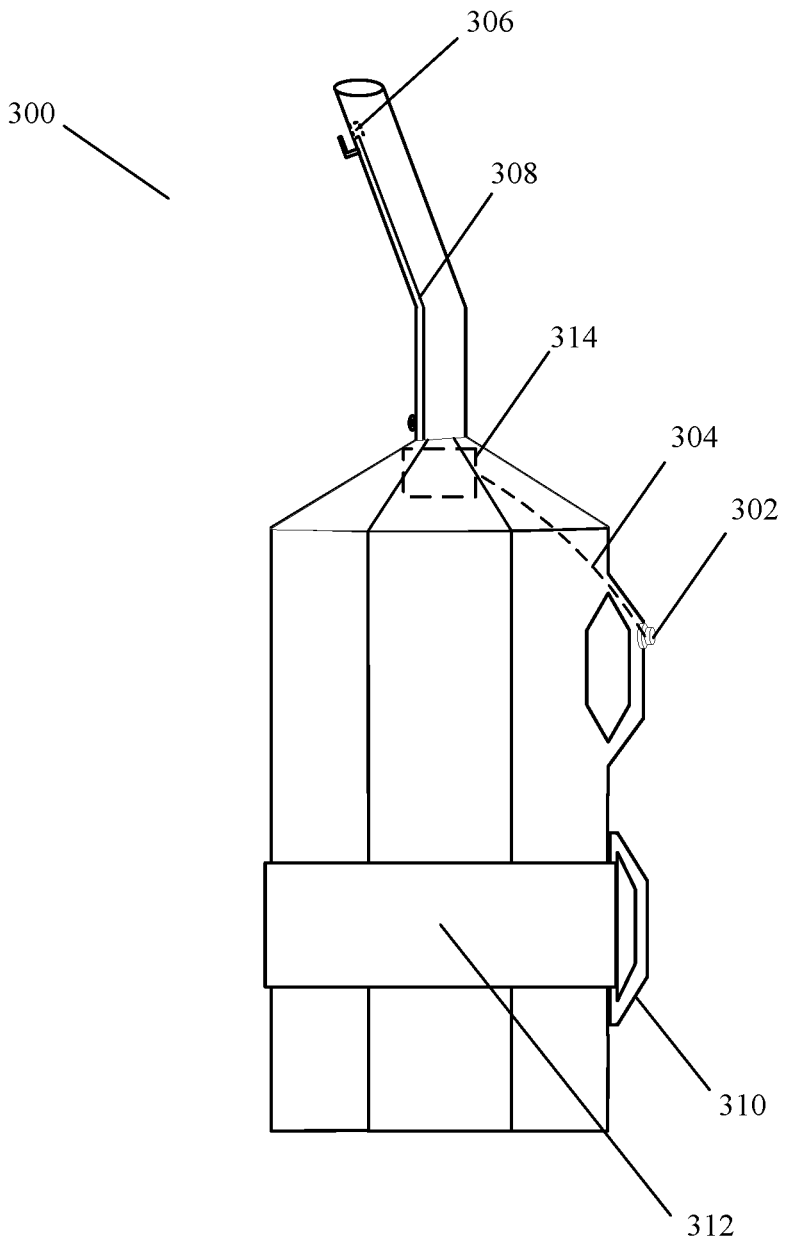
FIG. 3 is a side view of one embodiment of the overflow prevention dispensing container.

FIG. 3 illustrates an electronic overflow prevention dispensing container 300. This is another embodiment of the overflow prevention dispensing container 100 using electronics to sense and control the flow of fuel. The electronic overflow prevention dispensing container 300 may comprise a dispensing button 302, dispensing button wiring 304, an electronic sensor 306, electronic sensing wiring 308, an electromechanical valve assembly 314, an external handle 310, and external handle strap 312. As previous discussed in FIG. 1 the dispensing handle 112 controls the flow of fuel into the fuel tank. In FIG. 3, this embodiment shows the election of a dispensing button 302 and the dispensing wiring 304 that controls the flow of the fluid via an electromechanical valve assembly 314

As before, the portable container 102 is placed in the refueling position then the dispensing button 302 is depressed which sends a signal through the dispensing button wiring 304 to the electromechanical valve assembly 314 that actuates the valve electrically allowing the flow of fuel to the fuel tank. As the fuel tank fills, the electronic sensor 306 repeatedly checks the fuel level inside the fuel tank and once the fuel reaches a predetermined level, the sensor 306 signals the electromechanical valve assembly 314 via the electronic sensor wiring 308 to stop the flow of fuel to the fuel tank. The electronics may be powered by batteries housed inside the electromechanical valve assembly 314. In FIG. 300, the automatic shutoff sensing means is selected from infrared detecting the level of the fluid inside the fuel tank and once the fuel tank has reached the desired level then sends a signal through the electronic sensor wiring 308 to the electro-mechanical valve 314 to immediately disengage the valve and prevent further fuel from flowing into the fuel tank.

Additionally, FIG. 3 illustrates another embodiment wherein only one of the handles 104 may be integrated and the other external handle 310 is affixedly attached by an external handle strap 312 to the portable container 102. This configuration allows a user to place the external handle 310 in multiple locations on the portable container 102.

Having thus described the invention, I claim:

1. An overflow prevention dispensing container comprising:

a. a portable container having—
  i. a plurality of handles,
  ii. a nozzle,
  iii. at least one sealable air vent positioned on the container to allow airflow into the container when the container is in its operational position and dispensing liquid,
  vi. at least one liquid fill aperture, and
  vii. a fill aperture cover;

b. a dispensing handle in cooperation with and protected by the container handle having—
  i. a valve mechanism; and
  ii. at least one release dispensing liquid proportional to the pressure applied;

c. an automatic shutoff sensor adapted to sense a level of fluid in a receiving tank and stop the flow of liquid into the receiving tank once full, whereby the container is placed in a position to dispense liquid to the receiving tank, the operator activates the dispensing handle allowing liquid to freely flow into the receiving tank until the apparatus senses the level of the liquid in the receiving tank to be desired level at which time the flow will automatically be stopped.

2. The apparatus of claim 1, where the container material is selected from plastic and metal.

3. The apparatus of claim 1, where the container shape is selected from cylindrical and polygonal.

4. The apparatus of claim 1, where each handle is integrated into the container.

5. The apparatus of claim 1, where each handle is attached externally to the container.

6. The apparatus of claim 1, where the fill cover is threadedly attached to prevent the fuel from leaking.

7. The apparatus of claim 1, where the fill cover remains mechanically connected to the container even when disengaged.

8. The apparatus of claim 1, where the container internal cavity has a plurality of perforated baffles to control the movement of the liquid thereby preventing the liquid sloshing.

9. The apparatus of claim 1, where the dispensing handle is selected from a lever, switch, and button to control the flow of the fluid.

10. The apparatus of claim 1, where the automatic shutoff sensor is selected from a group consisting of air pressure, ultrasonic, infrared, laser, and radar.

11. The apparatus of claim 1, where the nozzle includes a positioner for placing the nozzle in a desired position inside the tank.

12. The apparatus of claim 1, where the container includes an attachment point for tethering the container to the vehicle being filled.

13. An overflow prevention dispensing container comprising:

a. a portable container having—
  i. at least one integrated handle,
  ii. a nozzle,
  iii. at least one sealable air vent positioned on the container to allow airflow into the container when the container is in its operational position and dispensing liquid,
  vi. at least one liquid fill aperture, and
  vii. a fill aperture cover;

b. a dispensing handle in cooperation with and protected by the container having—
  i. a valve mechanism controlling the flow of a liquid; and
  ii. at least one release lever dispensing liquid proportional to the pressure applied;

c. an air pressure automatic shutoff, whereby the container is placed in a position to dispense liquid to a receiving tank, an operator activates the dispensing handle allowing liquid to freely flow into the receiving tank until the air pressure changes due to the level of the fuel in the receiving tank to be desired level at which time the flow will automatically be stopped.

* * * * *